United States Patent [19]

Takamura et al.

[11] Patent Number: 4,560,845

[45] Date of Patent: Dec. 24, 1985

[54] KEYBOARD

[75] Inventors: Toshiro Takamura; Muneharu Kakumu, both of Nagoya, Japan

[73] Assignees: Brother Kogyo Kabushiki Kaisha; Showa Seiki Kabushiki Kaisha, both of Nagoya, Japan

[21] Appl. No.: 661,863

[22] Filed: Oct. 15, 1984

[30] Foreign Application Priority Data

Oct. 20, 1983 [JP] Japan ..... 58-197036
Oct. 20, 1983 [JP] Japan ..... 58-197037

[51] Int. Cl.[4] ..... H01H 9/00; H01H 13/70

[52] U.S. Cl. ..... 200/5 A; 200/159 B; 200/293; 235/145 R; 400/488

[58] Field of Search ..... 200/5 A, 159 B, 292–296, 200/302.2, 340; 361/398, 288; 235/145 R; 400/479, 485, 489, 490, 495

[56] References Cited

U.S. PATENT DOCUMENTS

| | | | |
|---|---|---|---|
| Re. 30,435 | 11/1980 | Fukao | 361/288 X |
| 3,311,210 | 3/1967 | Peroni | 400/479 |
| 4,271,333 | 6/1981 | Adams et al. | 200/5 A X |
| 4,294,555 | 10/1981 | Galaske et al. | 400/490 X |
| 4,363,942 | 12/1982 | Deeg et al. | 400/495 X |
| 4,423,464 | 12/1983 | Tamura et al. | 361/288 |
| 4,440,515 | 4/1984 | Nassimbene | 400/490 X |
| 4,467,150 | 8/1984 | Leitermann et al. | 400/488 X |

*Primary Examiner*—J. R. Scott
*Attorney, Agent, or Firm*—Browdy and Neimark

[57] ABSTRACT

A keyboard having multiple key-switches each comprising a key having a finger-pressed top face, a movable electrode and at least two stationary electrodes. The keyboard comprises a key holder plate of generally planar flat shape supporting the multiple keys in plural rows movably in a direction perpendicular to a plane of the key holder plate, and retaining device for holding the key holder plate downwardly convexed in cross section across the plural rows of keys, with elastic deformation of the key holder plate. The key holder plate has a deformation-facilitating portion located between each pair of rows of keys, and having a longitudinal recess array formed in parallel to the rows of keys, having a plural number of recesses in the upper and lower surfaces of the key holder plate, as viewed in a direction perpendicular to the rows of keys.

14 Claims, 10 Drawing Figures

KEYBOARD

BACKGROUND OF THE INVENTION

The present invention relates to a keyboard assembly for providing electrical outputs corresponding to multiple keys, to signal utilization electronic devices such as typewriters and other data processing equipment.

In such a keyboard for electronic devices, a multiplicity of keys are disposed in plural rows to provide electric signals corresponding to the keys which have been depressed on their top faces. To improve ease of operation of the keys, attempts based on human engineering or ergonomics have been made to arrange the keys such that an operating surface generally defined by the top faces of the individual keys is curved to a downwardly convex shape in cross section taken along a line perpendicular to the rows of the keys.

A keyboard, which can be manufactured at low cost, is proposed as disclosed in U.S. patent application, Ser. No. 598,920 filed Apr. 10, 1984 now U.S. Pat. No. 4,528,428, assigned to one of the assignees of the present application, and in U.S. patent application, Ser. No. 624,395 filed June 25, 1984 in the name of the present inventors. Such a keyboard has multiple key-switches each comprising a key having a finger-pressed top face, a movable electrode and at least two stationary electrodes. The keyboard includes a key holder plate of generally planar flat shape and retaining means thereof. The key holder plate supports the multiple keys in plural rows movably in a direction perpendicular to a plane of the key holder plate, and has holes through which the keys extend and integral guide portions formed around each of the holes and extending in the aforementioned direction. The key holder plate further has a deformation-facilitating portion located between each pair of adjacent rows of the plural rows of keys. The deformation-facilitating portion has a single longitudinal recess formed in parallel to the rows of keys. The retaining means holds the key holder plate such that the plate is downwardly convexed in cross section across the rows of keys mainly owing to elastic deformation of the deformation-facilitating portion, whereby a surface generally defined by the top faces of the multiple keys is downwardly convexed in the cross section.

In such a keyboard, the key holder plate is curved downwardly after assembling, whereby multiple guide portions provided in the key holder plate are directed unparallel to each other. If it is attempted to mold a key holder plate of such a shape, molds would inevitably be extremely complicated in structure to enable the removal of a molded key holder plate from the molds, and molding cycle time would also be long. However, since the key holder plate of the preceding applications is generally of a planar flat shape and multiple guide portions are directed parallel to each other before assembling, the key holder plate can be molded in simply structured molds which can be opened and closed in a direction perpendicular to the key holder plate, resulting in reduced cost of manufacture of the keyboard.

In order to facilitate elastic deformation of the key holder plate as mentioned above, it is desired to reduce the thickness of the key holder plate. In consideration of a molding process and rigidity of the key holder plate, however, it is not desired to reduce the thickness of the key holder plate. In the keyboard described in the specifications of the two preceding applications, therefore, the key holder plate is provided with recesses each formed in a deformation-facilitating portion located between two adjacent rows of keys such that these portions are curved more easily than the other portions. Each of these recesses has a long longitudinal shape formed in a direction parallel to the rows of keys, and only one recess is provided between two adjacent rows of keys of the key holder plate as viewed in a direction perpendicular to the rows of keys.

SUMMARY OF THE INVENTION

An object of the present invention is to provide a keyboard having a greater degree of freedom for designing a key holder plate which can be downwardly convexed as aforementioned.

In the keyboard according to the present invention, the key holder plate has a deformation-facilitating portion located between at least one pair of adjacent rows of the plural rows of keys. The deformation-facilitating portion has the longitudinal recesses in plural number in total in an upper and a lower surface of the key holder plate, as viewed in a direction perpendicular to the rows of keys.

According to the present invention there is provided a keyboard having multiple key-switches each comprising a key having a finger-pressed top face, a movable electrode and at least two stationary electrodes, comprising (i) a key holder plate of generally planar flat shape supporting the multiple keys in plural rows movably in a direction perpendicular to a plane of the key holder plate, the key holder plate having holes through which the keys extend and guide portions integrally formed around each of the holes and extending in the direction, the key holder plate further having a deformation-facilitating portion located between at least one pair of adjacent rows of the plural rows of keys, the deformation-facilitating portion having a longitudinal recess array or means which is formed in parallel to said rows of keys and which consists of a plural total number of longitudinal recesses in upper and lower surfaces of the key holder plate, as viewed in a direction perpendicular to the rows of keys, and (ii) retaining means for holding the key holder plate downwardly convexed in cross section across the plural rows of keys, the retaining means defining a curvature and having means for holding the key holder plate elastically deformed following the curvature, whereby a surface generally defined by the top faces of the multiple keys is downwardly convexed in the cross section across the rows of keys.

In a preferred embodiment of the present invention the longitudinal recesses include a recess formed in the upper surface of the key holder plate and another recess formed in the lower surface thereof. The recesses may be provided at the same positions of the upper and lower surfaces in the direction perpendicular to the rows of keys, and may be open to each other at their bottoms and form a through hole through a thickness of the key holder plate. The through holes are preferably arranged at equal intervals in a row in a direction parallel to the rows of keys.

In another preferred embodiment of the present invention the longitudinal recesses include two first recesses which are formed in one of the upper and lower surfaces of the key holder plate and spaced from each other in the direction perpendicular to the rows of keys, and may further include a second recess which is formed in the other surface of the key holder plate in a position between the two first recesses.

Such plural recesses provide a greater degree of freedom for designing the key holder plate and allow the key holder plate to be curved to a desired downward shape as compared to only one recess.

BRIEF DESCRIPTION OF THE DRAWING

The above and other objects, features and advantages of the present invention will become more apparent from reading the following description of the preferred embodiments taken in connection with the accompanying drawing in which.

DETAILED DESCRIPTION OF THE PREFERRED EMBODIMENTS

Figure 1:
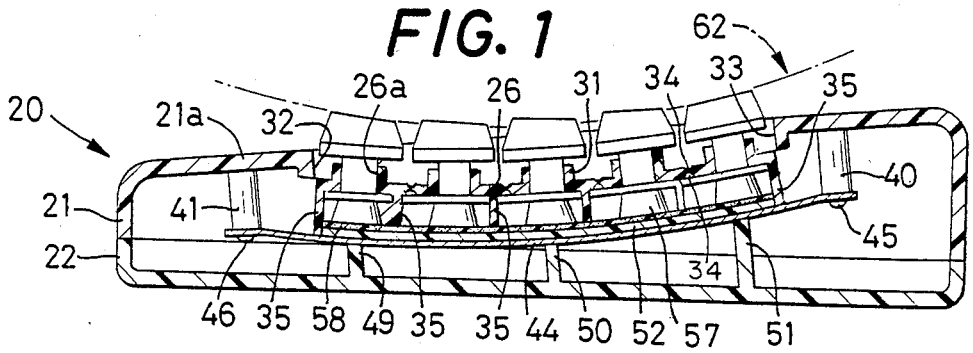
FIG. 1 is an elevational view in cross section of one embodiment of a keyboard of the invention.
Figure 2:
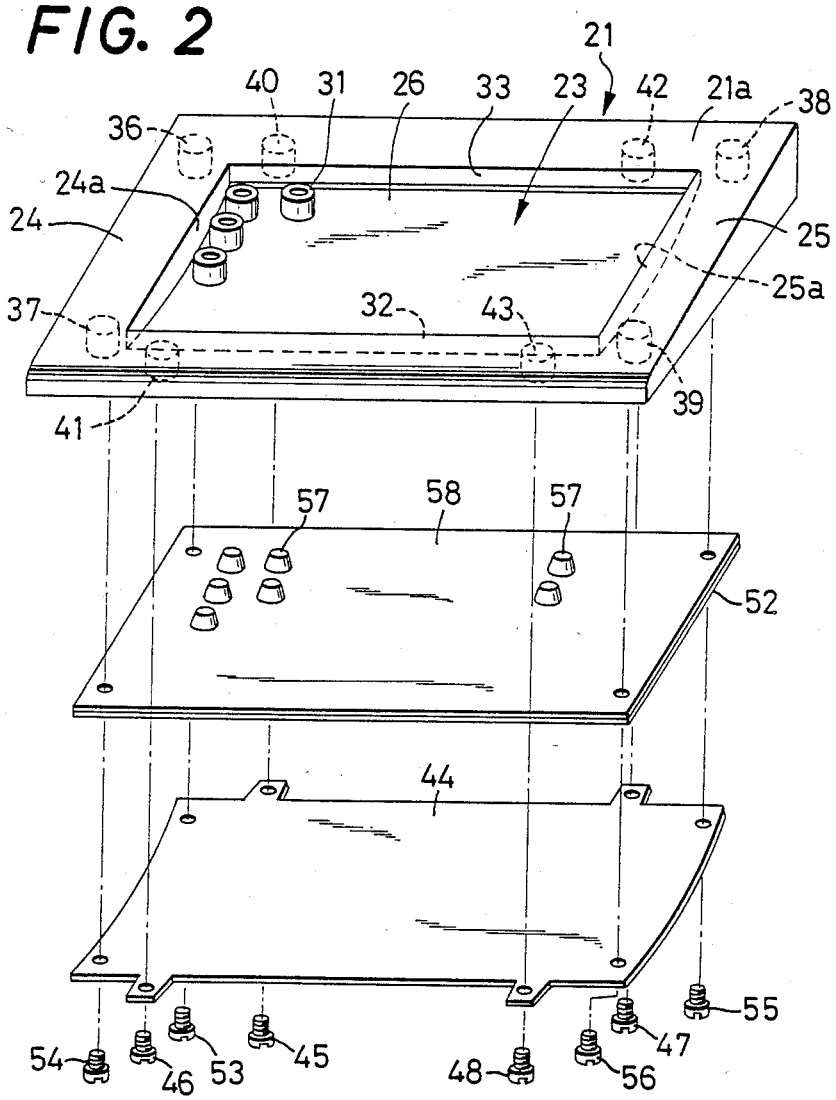
FIG. 2 is an exploded perspective view of the keyboard of FIG. 1.

Referring first to FIGS. 1–7, there is illustrated a first embodiment of a keyboard of the present invention, wherein a keyboard housing generally indicated at 20 in FIG. 1 includes an upper casing 21 and a lower casing 22, both made of synthetic resin in a plastic molding process. As shown in FIG. 2, the upper casing 21 includes a generally planar top frame portion 21*a* which has a substantially rectangular aperture 23 formed through the thickness of the portion 21*a*. The top frame portion 21*a* has a pair of side walls 24, 25 which define opposite right and left sides of the rectangular aperture 23. Each of the side walls 24, 25 has a downward extension 24*a*, 25*a* from the lower surface of the top frame portion 21*a*. Each of downward extensions 24*a*, 25*a* has a convex profile at its lower end.

The top frame portion 21*a* is formed integrally with a key-holder plate portion 26 of generally planar flat shape which is disposed below the lower surface of the top frame portion 21*a* so as to close the rectangular aperture 23. As partly shown in FIG. 3, the upper casing 21 is molded such that the right and left side end regions of the key-holder plate portion 26 are spaced a very small distance from the right and left downward extensions 24*a*, 25*a* toward the center of the portion 26 in a direction perpendicular to the side walls 24, 25. More precisely stated, a central part 24*a'*, 25*a'* (25*a'* not shown) of each downward extension 24*a*, 25*a* is connected, during molding of the upper casing 21, to a transversely central area 26*b* of each side end region of the key-holder plate portion 26. Except the transversely central area 26*b*, the key-holder plate portion 26 is spaced or separated from the remaining parts of the top frame portion 21*a*. In other words, the upper casing 21 is molded so that the key-holder plate portion 26 takes a straight planar shape, i.e., lies in a plane. As described later, the key-holder plate portion 26 is curved during assembling of the keyboard.

Figure 3:
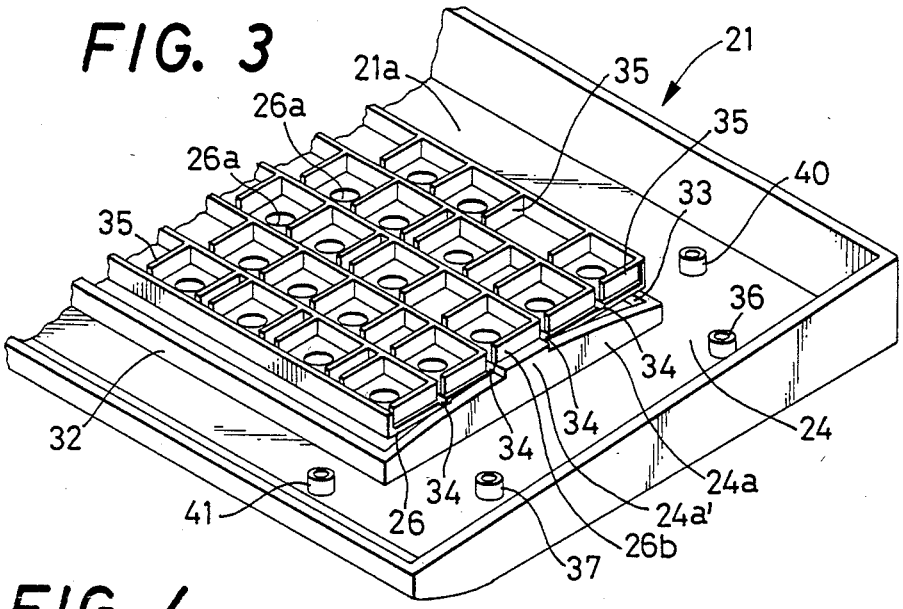
FIG. 3 is a perspective bottom view of an upper casing of the keyboard of FIGS. 1 and 2.
Figure 4:
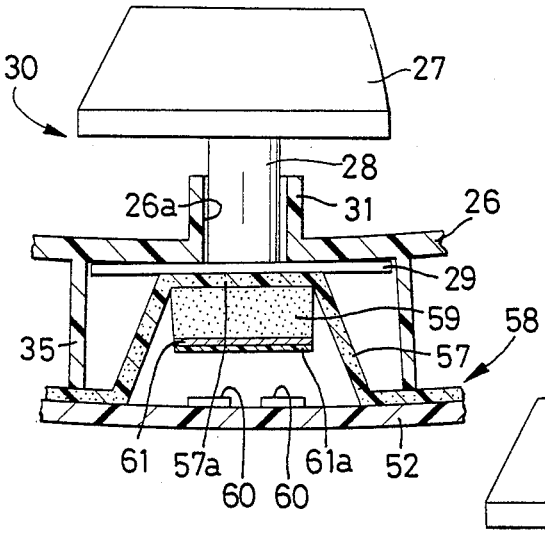
FIG. 4 is a cross sectional view in enlargement, showing one of key switches incorporated in the keyboard of FIGS. 1–3.

As shown in FIGS. 1 and 3, a multiplicity of holes 26*a* are formed in the key-holder plate portion 26 in plural rows parallel to the front and rear sides of the rectangular aperture 23. Along the peripheral edge of each of these holes 26*a*, is integrally formed an annular guide portion 31 which is concentric with the hole 26*a* and extends perpendicularly from an upper surface of the key-holder plate portion 26 towards the rectangular aperture 23, to support a key 30 which consists of, as shown in FIG. 4, a keystem 28, a key top 27 fixed to an upper end of the keystem 28, and a bottom plate 29 of substantially rectangular shape which is fixed to a lower end of the keystem 28. The keystem 28 is inserted through the hole 26*a* and the annular guide portion 31, such that the key 30 is slidably movable in a direction perpendicular to the plane of the key-holder plate portion 26. Thus, the keys 30 are movably supported in plural rows parallel to front and rear sides 32, 33 of the rectangular aperture 23.

Figure 6:
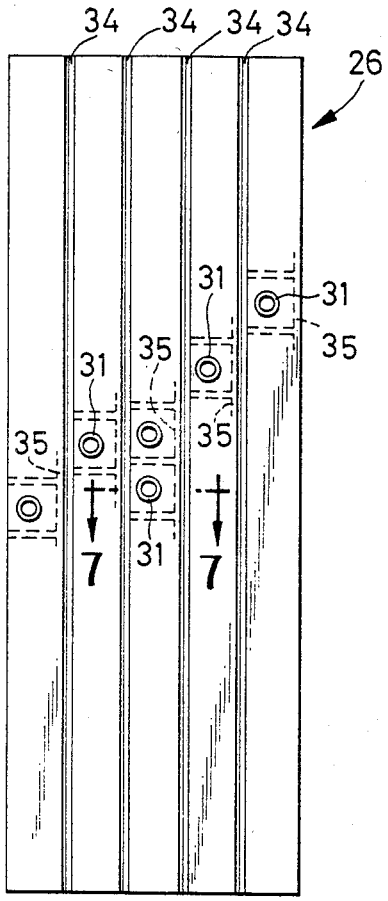
FIG. 6 is a top plan view, illustrating only the key holder plate of the keyboard shown in FIG. 1 or FIG. 3.
Figure 7:
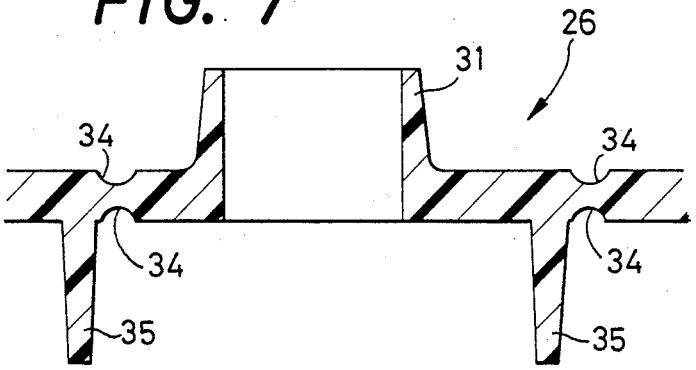
FIG. 7 is a cross sectional view of a portion of the key holder plate of FIG. 6 taken along the line 7—7 of FIG. 6.

As shown in FIGS. 6 and 7, the key-holder plate portion 26 has, in its upper surface, four parallel grooves 34 of generally U-shaped cross section which are formed parallel to the front and rear sides 32, 33 of the aperture 23, and between the rows of the holes 26*a*. The key-holder plate portion 26 also has, in its lower surface, four parallel grooves 34. These grooves 34 are disposed in positions opposite to the aforementioned grooves 34 formed in the upper surface, i.e. in the same positions in a direction perpendicular to the rows of keys, and are formed in the same U-shaped cross section and dimensions as the grooves 34 in the upper surface. That is, in the present embodiment, one groove is formed in each of the upper and lower surfaces of the key-holder plate portion 26 in a portion located between two adjacent rows of keys, i.e., a longitudinal recess array or means consisting of two longitudinal recesses is formed in a deformation-facilitating portion between two adjacent rows of keys. These grooves 34 are provided to facilitate elastic deformation of the plate portion 26 which will be described later. For effective deformation of the plate portion 26, the two pair of outer grooves 34 have a depth greater than that of the two pair of inner grooves 34. In the case where many of such parallel grooves are provided, a depth of the grooves is increased as a distance of the groove from the transverse center of the plate portion 26 is increased.

On the lower surface of the key-holder plate portion 26, there are integrally formed multiple partition walls 35 which extend downwardly from the lower surface of the plate portion 26 so as to define multiple rectangular compartments in which the bottom plate 29 of each key 30 is guied upon movement of the key. In addition, the partition wall 35 serve to prevent the bottom plate 29 (and consequently the key 30) from rotating about an axis of the keystem 28.

The top frame portion 21*a* is provided with plural downward bosses 40–43 which protrude downwardly from the lower surface of the portion 21*a*. To the downward bosses 40–43 is fixed with fixing screws 45–48 a rigid curved retainer plate 44 made of metal which has a predetermined downward curvature in cross section across the rows of the keys 30, i.e., in a plane perpendicular to the front and rear sides 32, 33 of the aperture 23. The curved retainer plate 44 is supported at its lower surface by plural upward projections in the form of three support walls 49, 50, 51 which extend from an inner bottom surface of the lower casing 22 such that the upper ends of the projections 49–51 abut on the lower surface of the curved retainer plate 44. These support walls 49–51 are formed parallel to the front and rear sides 32, 33 of the aperture 23, and spaced from each other along the right and left sides of the aperture 23.

Figure 5:
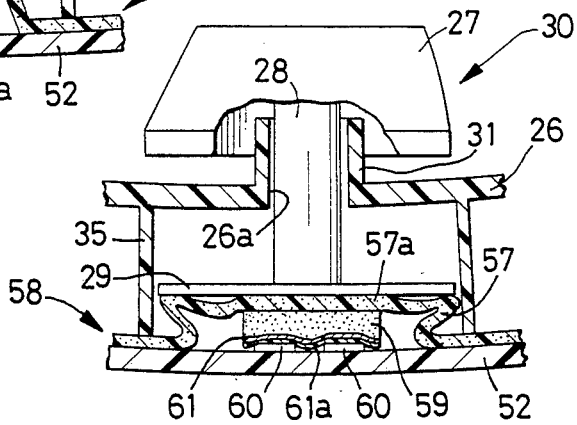
FIG. 5 is a cross sectional view in enlargement, showing the key switch of FIG. 4 in its closed or operated position upon depression of the key.

A printed circuit board 52 rests on an upper surface of the curved retainer plate 44. The printed circuit board 52 and the retainer plate 44 are fastened to the lower ends of the downward bosses 36–39 located on the undersurface of the top frame portion 21*a* of the upper casing 21, with fixing screws 53–56, respectively, such that the printed circuit board 52 backed by the curved retainer plate 44 is also curved following the curvature of the retainer plate 44. The circuit board 52 comprises a substrate which carries on its upper surface a printed pattern of conductors, i.e., multiple pairs of stationary electrodes 60 as shown in FIGS. 4 and 5. The substrate carries, also on its upper surface, an elastomeric member 58 which is formed with multiple frusto-conical or inverted-cup-shaped elastic housings 57 made of rubber, each of which cooperates with the substrate to enclose the corresponding pair of stationary electrodes 60. Each frusto-conical elastic housing 57 has a top wall 57*a* which is spaced from and opposite to the stationary electrodes 60. A sponge member 59 is bonded at one surface thereof to an inner surface of the top wall 57*a* of the elastic housing 57. The sponge member 59 carries on the other surface thereof a movable electrode 61 made of flexible aluminum foil which is covered with a thin insulating film 61*a* made of flexible synthetic resin, such that the movable electrode 61 faces the stationary electrodes 60 via the insulating film 61*a*. This movable electrode 61 cooperates with the pair of stationary electrodes 60 to constitute a variable capacitor.

With the keyboard assembled as described later in greater detail, the key-holder plate portion 26 is held curved with the partition wall 35 held in contact with the elastomeric member 58 on the printed circuit board 52 which is held curved in contact with the curved upper surface of the retainer plate 44, because the retainer plate 44 is fixed to the top frame portion 21*a* of the upper casing 21. In this condition, the key-holder plate portion 21*a* is positioned so that the frusto-conical elastic housings 57 of the elastomeric member 58 are disposed within the compartments defined by the partition walls 35, and so that the bottom plate 29 of the key 30 rests on the top wall 57*a* of the elastic housing 57. More specifically described, the key 30 is biased by the elastic housing 57 and normally held in its upper, non-operated position of FIG. 4. In this non-operated position, the bottom plate 29 of the key 30 is forced against the lower surface of the key-holder plate portion 26, and the movable electrode 61 is separated from the stationary electrodes 60.

Each of the key switches constructed as described hitherto, is operated in the following manner:

Upon depression of the keytop 27 while the key 30 is located at its upper position of FIG. 4, the keystem 28 is moved downward while being guided by the annular guide portion 31, whereby the top wall 57*a* of the elastic housing 57 is forced down by the bottom plate 29 of the key 30. As a result, the assembly of the sponge member 59 and movable electrode 61 fixed to the top wall 57*a* is moved toward the printed circuit board 52, and the movable electrode 61 covered with the insulating film 61*a* is brought into contact with the pair of stationary electrodes 60 as shown in FIG. 5. In this operated position, the two stationary electrodes 60 are capacitively coupled to each other, and a high frequency signal is transferred from one of the electrodes 60 to the other. Since the movable electrode 61 is carried by the elastic sponge member 59 bonded to the top wall 57*a*, the movable electrode 61 may be held in close and perfect contact with the outer surfaces of the stationary electrodes 60, through elastic deformation of the sponge member 59, thereby assuring a stable transfer of the high frequency signal of sufficiently high level between the two stationary electrodes 60.

When the operator's finger pressure is released from the keytop 27, the resilient force of the elastic housing 57 causes the key 30 and the movable electrode assembly 59, 61, 61*a* to be moved upward to their original non-operated position of FIG. 4, whereby the movable electrode 61 is separated from the stationary electrodes 60, and the signal transfer between the two stationary electrodes 60 is ceased.

In the non-operated position, the rectangular bottom plate 29 of the key 30 prevents the keystem 28 from being pulled out of the annular guide portion 31, and cooperates with the partition wall 35 to avoid otherwise possible rotary movements of the key 30.

The keyboard of the present embodiment comprising the components which have been discussed, is assembled in the following manner:

In assembling the keyboard, the printed circuit board 52 is first placed on the curved retainer plate 44. Then, the elastomeric member 58 with the integrally formed elastic housings 57 is set on the printed circuit board 52. In the meantime, the keystems 28 with the bottom plates 29 are set in the key-holder plate portion 26 such that the keystems 28 are slidably movable through the holes 26*e* and the annular guide portions 31. The keytops 27 are then secured to the keystems 28. The curved retainer plate 44, and the board 52 and the member 58 set on the retainer plate 44, are fixed to the top frame portion 21*a* of the upper casing 21 with the fixing screws 53–56 threaded to the downward bosses 36–39. Further, the curved retainer plate 44 is secured to the top frame portion 21*a* with the fixing screws 45–48 screwed to the downward bosses 40–43, in order to complete the flexture of the key-holder plate portion 26 to the exact curvature of the retainer plate 44. When the assembly 44, 52, 58 is secured to the upper casing 21 with the screws 45–48 and 53–56, the key-holder plate portion 26 is comparatively easily curved with the aid of the parallel grooves 34, and the curved retainer plate 44 serves to hold the printed circuit board and the elastomeric member 52, 58 as well as the key-holder plate portion 26 in their curved posture. With the key-holder plate portion 26 thus retained in its curved posture, the keys 30 of the same size are supported by the key-holder plate portion 26 of the upper casing 21 so that the top faces of the keytops 27 define an operating surface 62 which is downwardly convexed to a curvature substantially identical to a curvature of the curved retainer plate 44.

Finally, the lower casing 22 is coupled to the upper casing 21 to form the keyboard housing 20.

As described previously, the key-holder plate portion 26 with the integral annular guide portions 31 is molded as an integral part of the upper casing 21, that is, integrally formed with the top frame portion 21*a* having the aperture 23. Accordingly, the keys 30 movably supported by the key-holder plate portion 26 can be accurately positioned relative to the aperture 23. In other words, the relative positions between the keys 30 and the aperture 23 are not affected by the manner in which the keyboard is assembled. Thus, the instant keyboard can be easily assembled with increased accuracy of positioning the keys 30 relative to the upper casing 21. The integral formation of the key supporting structure and the top frame further results in reduction in total number of parts of the keyboard, and in the cost of manufacture.

However, it should be understood that in case the key-holder plate portion 26 is molded separately from the top frame portion 21*a*, the present invention still provides the same effect, and therefore, does not exclude the key-holder plate portion 26 separately molded from the top frame portion 21*a*.

As discussed previously, the key-holder plate portion 26 is provided with the annular guide portions 31 and the partition walls 35 which are formed on the flat surfaces of the planar substrate. That is, the key-holder plate portion 26 is molded to be of generally flat shape, and subsequently curved or flexed through elastic deformation thereof during the assembling of the keyboard. This design permits easy removal of molds that are used to mold the upper casing 21 with the guide portions 31 and the partition walls 35.

Figure 8:
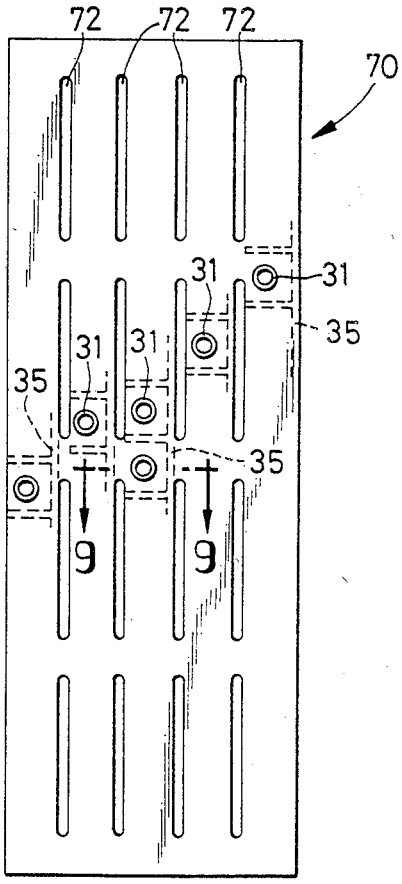
FIG. 8 is a top plan view of the key holder plate in another embodiment of the keyboard.
Figure 9:
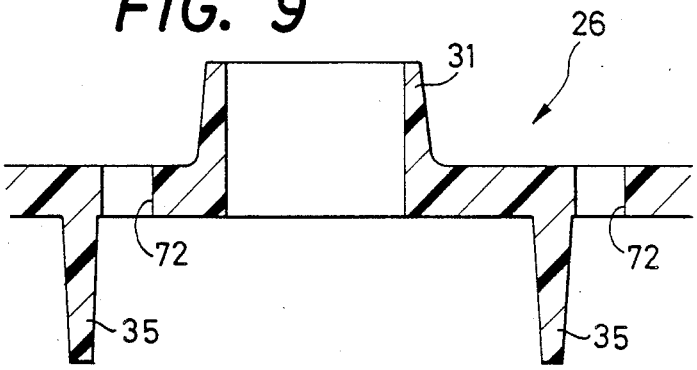
FIG. 9 is a cross sectional view of a portion of the key holder plate of FIG. 8 taken along the line 9—9 of FIG. 8.

FIGS. 8 and 9 show another embodiment of the present invention. As shown in these figures, a plurality of slots 72 are formed as a longitudinal recess array or means between every pair of adjacent rows of keys in the key-holder plate portion 70. Although plural slots 72 are arranged between each pair of adjacent rows of keys in a direction parallel to the rows of keys, only one slot 72 is disposed as viewed in a direction perpendicular to the rows of keys. These slots 72 correspond to the grooves 34 which are formed, as explained in the preceding embodiment shown in FIG. 7, in each of the upper and lower surfaces of the key-holder plate 26, and one slot 72 can be regarded as two reesses which are formed in the upper and lower surfaces, respectively, and are opened or connected to each other at their bottoms. In the present embodiment, therefore, it can also be regarded that two longitudinal recesses are formed in a portion located between two adjacent rows of keys of the key-holder plate portion 70, as viewed in a direction perpendicular to the rows of keys. However, in the case where a slot passing through a thickness of the key-holder plate portion 70 is formed continuously over an almost full length of the key-holder plate portion 70, the key-holder plate portion 70 will not have enough strength. Therefore, a plurality of slots are formed at equal intervals in a direction parallel to the rows of keys, and portions located on both sides of the slots 72 in the key-holder plate portion 70 connect to each other between the slots 72 adjacent to each other in the direction parallel to the rows of keys and beside at both ends of the key-holder plate portion 70. Since these connecting portions can be curved more easily than the other portions, the present embodiment can also provide the effect of the invention. A detailed explanation of the other portions is omitted because the other portions in the present embodiment are the same as those in the preceding embodiment.

Figure 10:
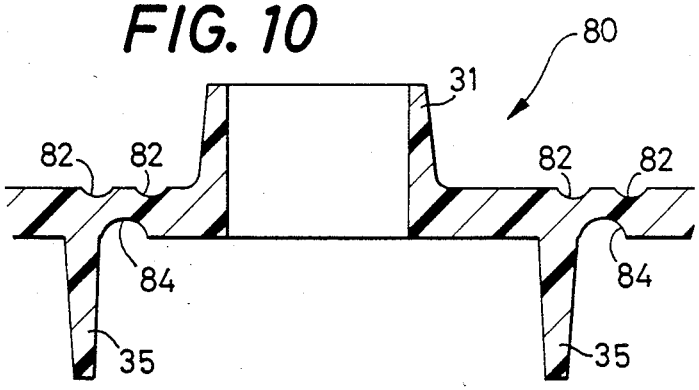
FIG. 10 is a view, corresponding to FIG. 9, of a further embodiment of the invention.

FIG. 10 shows a still another embodiment of the present invention. In this embodiment, two grooves 82 are formed in the upper surface and one groove 84 is formed in the lower surface of a portion located between every pair of adjacent rows of keys of the key-holder plate portion 80. The grooves 82 are formed with a space provided therebetween in a direction perpendicular to the rows of keys, and the groove 84 in the lower surface is formed in the middle of the grooves 82 in the upper surface. Although the grooves 84 and 82 have the same U-shaped cross section, the groove 84 has a larger cross sectional area than the groove 82. In the case where three or more longitudinal recesses are formed in a portion located between two adjacent rows of keys of the key-holder plate portion 80 as previously mentioned, portions curved more easily than the other portions will be larger in width, whereby the key-holder plate portion 80 can be curved far more easily.

Further, though not shown, many changes and modifications can be made in the invention, such as a change in the number of recesses or a modification in the cross sectional shape, without departing from the spirit or scope of the invention.

What is claimed is:

1. A keyboard having multiple key-switches each comprising a key having a finger-pressed top face, a movable electrode and at least two stationary electrodes, comprising:

a key holder plate of generally planar flat shape supporting the multiple keys in plural rows movably in a direction perpendicular to a plane of the key holder plate, said key holder plate having holes through which said keys extend and guide portions integrally formed around each of said holes and extending in said direction, said key holder plate further having a deformation-facilitating portion located between at least one pair of adjacent rows of said plural rows of keys, said deformation-facilitating portion having a longitudinal recess array which is formed in parallel to said rows of keys and which consists of a plural total number of longitudinal recesses in upper and lower surfaces of said key holder plate, as viewed in a direction perpendicular to said rows of keys;

retaining means for holding said key holder plate downwardly convexed in cross section across said plural rows of keys, said retaining means defining a curvature and having means for holding said key holder plate elastically deformed following said curvature, whereby a surface generally defined by the top faces of said multiple keys is downwardly convexed in said cross section; and a housing containing said multiple key-switches, said key holder plate and said retaining means.

2. A keyboard according to claim 1, wherein said longitudinal recesses include a recess formed in said upper surface and another recess formed in said lower surface.

3. A keyboard according to claim 2, wherein said longitudinal recesses include recesses provided at the same positions of said upper and lower surfaces in said direction perpendicular to said rows of keys.

4. A keyboard according to claim 3, wherein said longitudinal recesses include recesses which are open to each other at their bottoms and form a through hole through a thickness of said key holder plate.

5. A keyboard according to claim 4, wherein said recesses which form said through holes are arranged at equal intervals in a row in a direction parallel to said rows of keys.

6. A keyboard according to claim 1, wherein said longitudinal recesses include two first recesses which are formed in one of said upper and lower surfaces and spaced from each other in the direction perpendicular to said rows of keys.

7. A keyboard according to claim 6, wherein said longitudinal recesses further include a second recess which is formed in the other surface in a position between said two first recesses.

8. A keyboard according to claim 1, wherein said key holder plate is an integral portion of an upper casing which is made of synthetic resin, said upper casing including a top frame portion which has a substantially rectangular aperture formed through its thickness and which further has a pair of side walls defining opposite right and left sides of said rectangular aperture, said top frame portion further having a pair of downward extensions which extend downwardly from the respective side walls, the key holder plate portion of the upper casing having right and left side end regions adjacent to said downward extensions, transversely central areas of said side end regions being connected to said downward extensions during molding of said upper casing.

9. A keyboard having multiple key-switches each comprising a key having a finger-pressed top face, a movable electrode and at least two stationary electrodes, comprising:

a key holder plate of generally planar flat shape supporting the multiple keys in plural rows movably in a direction perpendicular to a plane of the key holder plate, said key holder plate having holes through which said keys extend and guide portions integrally formed around each of said holes and extending in said direction, said key holder plate further having a deformation-facilitating portion located between at least one pair of adjacent rows of said plural rows of keys, said deformation-facilitating portion having a plural number of longitudinal recesses formed in one of upper and lower surfaces of said key holder plate in parallel to said rows of keys, said longitudinal recesses being spaced from each other in a direction perpendicular to said rows of keys; and retaining means for holding said key holder plate downwardly convexed in cross section across said plural rows of keys, said retaining means defining a curvature and having means for holding said key holder plate elastically deformed following said curvature, whereby a surface generally defined by the top faces of said multiple keys is downwardly convexed in said cross section; and a housing containing said multiple key-switches, said key holder plate and said retaining means.

10. A keyboard according to claim 9, wherein said deformation-facilitating portion further has a longitudinal recess formed in the other surface of said key holder plate in parallel to said rows of keys.

11. A keyboard according to claim 10, wherein said plural number of longitudinal recesses formed in said one surface of said key holder plate are two longitudinal recesses, said longitudinal recess formed in said other surface of the key holder plate being located between said two longitudinal recesses in said direction.

12. A keyboard having multiple key-switches each composing a key having a finger-pressed top face, a movable electrode and at least two stationary electrodes, comprising:

a key holder plate of generally planar flat shape supporting the multiple keys in plural rows movably in a direction perpendicular to a plane of the key holder plate, said key holder plate having holes through which said keys extend and guide portions integrally formed around each of said holes and extending in said direction, said key holder plate further having a deformation-facilitating portion located between at least one pair of adjacent rows of said plural rows of keys, said deformation-facilitating portion having a first longitudinal recess in an upper surface of said key holder plate, and a second longitudinal recess in a lower surface of the key holder plate, said first and second longitudinal recesses being formed in parallel to said rows of keys; and retaining means for holding said key holder plate downwardly convexed in cross section across said plural rows of keys, said retaining means defining a curvature and having means for holding said key holder plate elastically deformed following said curvature, whereby a surface generally defined by the top faces of said multiple keys is downwardly convexed in said cross section; and a housing containing said multiple key-switches, said key holder plate and said retaining means.

13. A keyboard according to claim 12, wherein said first and second longitudinal recesses are formed at the same positions of said upper and lower surfaces of the key holder plate, as viewed in a direction perpendicular to said rows of keys.

14. A keyboard having multiple key-switches each comprising a key having a finger-pressed top face, a movable electrode and at least two stationary electrodes, comprising:

a key holder plate of generally planar flat shape supporting the multiple keys in plural rows movably in a direction perpendicular to a plane of the key holder plate, said key holder plate having holes through which said keys extend and guide portions integrally formed around each of said holes and extending in said direction, said key holder plate further having a deformation-facilitating portion located between at least one pair of adjacent rows of said plural rows of keys, said deformation-facilitating portion having a plural number of longitudinal slots which are formed through the thickness of said key holder plate, said slots being arranged in space-apart relation with each other in a row in a direction parallel to said rows of keys; and retaining means for holding said key holder plate downwardly convexed in cross section across said plural rows of keys, said retaining means defining a curvature and having means for holding said key holder plate elastically deformed following said curvature, whereby a surface generally defined by the top faces of said multiple keys is downwardly convexed in said cross section; and a housing containing said multiple key-switches, said key holder plate and said retaining means.

* * * * *